US012247322B2

(12) United States Patent
Sagerer-Foric

(10) Patent No.: US 12,247,322 B2
(45) Date of Patent: Mar. 11, 2025

(54) METHOD FOR PRODUCING SPUNBONDED FABRIC

(71) Applicant: LENZING AKTIENGESELLSCHAFT, Lenzing (AT)

(72) Inventor: Ibrahim Sagerer-Foric, Vöcklabruck (AT)

(73) Assignee: Lenzing Aktiengesellschaft, Lenzing (AT)

( * ) Notice: Subject to any disclaimer, the term of this patent is extended or adjusted under 35 U.S.C. 154(b) by 176 days.

(21) Appl. No.: 17/801,595

(22) PCT Filed: Feb. 24, 2021

(86) PCT No.: PCT/EP2021/054497

§ 371 (c)(1),
(2) Date: Aug. 23, 2022

(87) PCT Pub. No.: WO2021/170609

PCT Pub. Date: Sep. 2, 2021

(65) Prior Publication Data

US 2023/0098304 A1 Mar. 30, 2023

(30) Foreign Application Priority Data

Feb. 24, 2020 (EP) ..... 20159095

(51) Int. Cl.
*D01D 5/14* (2006.01)
*D01D 5/098* (2006.01)
(Continued)

(52) U.S. Cl.
CPC ..... *D01D 5/0985* (2013.01); *D01D 5/14* (2013.01); *D01F 2/00* (2013.01); *D04H 3/11* (2013.01);
(Continued)

(58) Field of Classification Search
None
See application file for complete search history.

(56) References Cited

U.S. PATENT DOCUMENTS 3,825,380 A 7/1974 Harding et al.
4,166,001 A 8/1979 Dunning et al.
(Continued)

FOREIGN PATENT DOCUMENTS

CN 101550611 B 12/2010
DE 3603814 A1 8/1987
(Continued)

*Primary Examiner* — Yung-Sheng M Tsui
(74) *Attorney, Agent, or Firm* — Venable LLP

(57) ABSTRACT

A process (100, 101) for the production of spunbonded nonwoven (1) and a device (200, 201) are shown, comprising an embossing pattern (10), wherein a spinning mass (2) is extruded through a plurality of nozzle holes of at least one spinneret (3, 30) to form filaments (4, 40) and the filaments (4, 40) are drawn by a drawing air stream (5, 50), in each case, in the extrusion direction, with the filaments (4, 40) being deposited on a perforated tray (7) of a conveying device (8) to form a spunbonded nonwoven (1). So as to allow an efficient, technically simple and inexpensive introduction of the embossing pattern into the spunbonded nonwoven, it is suggested that the perforated tray (7) has an embossing structure (9) with an embossing pattern (10), the filaments (4, 40) are pressed into the embossing structure (9) by the drawing air stream (5, 50) and the spunbonded nonwoven (1) thus formed is provided with the embossing pattern (10).

11 Claims, 3 Drawing Sheets

(51) Int. Cl.

| | |
|---|---|
| ***D01F 2/00*** | (2006.01) |
| ***D04H 3/11*** | (2012.01) |
| ***D04H 3/16*** | (2006.01) |
| ***D06M 13/525*** | (2006.01) |

(52) U.S. Cl.
CPC ..... *D04H 3/16* (2013.01); *D06M 13/525* (2013.01); *D10B 2201/22* (2013.01)

(56) References Cited

U.S. PATENT DOCUMENTS

| | | | |
|---|---|---|---|
| 4,380,570 | A | 4/1983 | Schwarz |
| 4,434,204 | A | 2/1984 | Hartman et al. |
| 4,523,350 | A | 6/1985 | Schmiedgen et al. |
| 4,755,421 | A | 7/1988 | Manning et al. |
| 5,080,569 | A | 1/1992 | Gubernick et al. |
| 5,284,703 | A | 2/1994 | Everhart et al. |
| 5,361,466 | A | 11/1994 | Robertson et al. |
| 5,487,655 | A | 1/1996 | Frey et al. |
| 5,587,225 | A | 12/1996 | Griesbach et al. |
| 5,695,377 | A | 12/1997 | Triebes et al. |
| 5,728,407 | A | 3/1998 | Matsui |
| 6,306,334 | B1 | 10/2001 | Luo et al. |
| 6,358,461 | B1 | 3/2002 | Law et al. |
| 6,861,025 | B2 | 3/2005 | Erickson et al. |
| 7,156,639 | B2 | 1/2007 | Baumeister |
| 7,432,219 | B2 | 10/2008 | Strandqvist et al. |
| 7,438,544 | B2 | 10/2008 | Glawion et al. |
| 7,690,902 | B2 | 4/2010 | Erickson et al. |
| 7,732,357 | B2 | 6/2010 | Annis et al. |
| 8,082,638 | B2 | 12/2011 | Muenstermann |
| 8,191,214 | B2 | 6/2012 | Luo et al. |
| 8,282,877 | B2 | 10/2012 | White et al. |
| 8,366,988 | B2 | 2/2013 | Chou et al. |
| 9,394,637 | B2 | 7/2016 | Knowlson et al. |
| 9,631,321 | B2 | 4/2017 | Brennan et al. |
| 9,696,088 | B2 | 7/2017 | Böhn et al. |
| 9,868,240 | B2 | 1/2018 | Chou et al. |
| 9,982,367 | B2 | 5/2018 | Goretzki et al. |
| 10,273,635 | B2 | 4/2019 | Miller, IV et al. |
| 11,136,700 | B2 | 10/2021 | Venema et al. |
| 2003/0234464 | A1 | 12/2003 | Erickson et al. |
| 2004/0013859 | A1 | 1/2004 | Annis et al. |
| 2004/0265415 | A1 | 12/2004 | Baumeister |
| 2005/0056956 | A1 | 3/2005 | Zhao et al. |
| 2005/0112980 | A1 | 5/2005 | Strandqvist et al. |
| 2007/0104812 | A1 | 5/2007 | Glawion et al. |
| 2007/0237849 | A1 | 10/2007 | Erickson et al. |
| 2008/0006310 | A1 | 1/2008 | Munstermann et al. |
| 2008/0197522 | A1 | 8/2008 | Schemken et al. |
| 2009/0186189 | A1 | 7/2009 | White et al. |
| 2009/0188090 | A1 | 7/2009 | Muenstermann |
| 2009/0233049 | A1 | 9/2009 | Jackson et al. |
| 2010/0162542 | A1 | 7/2010 | Luo et al. |
| 2010/0236034 | A1* | 9/2010 | Eagles ..... D21F 1/0072 28/100 |
| 2011/0156303 | A1 | 6/2011 | Chou et al. |
| 2011/0244199 | A1 | 10/2011 | Brennan et al. |
| 2014/0170402 | A1 | 6/2014 | Knowlson et al. |
| 2015/0267965 | A1 | 9/2015 | Böhn et al. |
| 2016/0145810 | A1 | 5/2016 | Miller, IV et al. |
| 2016/0214302 | A1 | 7/2016 | Chou et al. |
| 2016/0312384 | A1 | 10/2016 | Goretzki et al. |
| 2018/0168893 | A1* | 6/2018 | Ashraf ..... D04H 3/16 |
| 2018/0282920 | A1 | 10/2018 | Carlyle et al. |
| 2019/0226133 | A1 | 7/2019 | Venema et al. |
| 2020/0100956 | A1* | 4/2020 | Ashraf ..... D04H 3/16 |
| 2020/0291545 | A1 | 9/2020 | Sagerer-Foric |
| 2021/0292949 | A1 | 9/2021 | Sagerer-Foric |
| 2023/0250558 | A1* | 8/2023 | Sommer ..... D04H 3/005 425/72.2 |

FOREIGN PATENT DOCUMENTS

| | | | |
|---|---|---|---|
| DE | 102009016019 | A1 | 10/2010 |
| DE | 102012109878 | A1 | 4/2014 |
| EP | 0333211 | A2 | 9/1989 |
| EP | 1445366 | A2 | 8/2004 |
| EP | 1486591 | A1 | 12/2004 |
| EP | 1567322 | B1 | 6/2009 |
| EP | 2041344 | B1 | 9/2009 |
| EP | 1873290 | B1 | 7/2013 |
| EP | 2462269 | B1 | 10/2013 |
| EP | 1616052 | B1 | 6/2016 |
| EP | 3088585 | A1 | 11/2016 |
| EP | 3254655 | A1 | 12/2017 |
| GB | 1474102 | A | 5/1977 |
| GB | 2114052 | A | 8/1983 |
| IN | 109989181 | A | 7/2019 |
| WO | 2012090130 | A2 | 7/2012 |
| WO | 2015000687 | A1 | 1/2015 |
| WO | 2018071928 | A1 | 4/2018 |
| WO | 2018184046 | A1 | 10/2018 |
| WO | 2018184048 | A1 | 10/2018 |
| WO | 2019068764 | A1 | 4/2019 |
| WO | 2020016296 | A1 | 1/2020 |

* cited by examiner

METHOD FOR PRODUCING SPUNBONDED FABRIC

CROSS REFERENCE TO RELATED APPLICATIONS

The present application is a national-stage entry under 35 U.S.C. § 371 of International Patent Application No. PCT/EP2021/054497, published as WO 2021/170609 A1, filed Feb. 24, 2021, which claims priority to EP 20159095.7, filed Feb. 24, 2020, the entire disclosure of each of which is hereby incorporated by reference.

BACKGROUND OF THE INVENTION

Field of the Invention

The present invention relates to a process for the production of spunbonded nonwoven with an embossing pattern, wherein a spinning mass is extruded through a plurality of nozzle holes of at least one spinneret to form filaments and the filaments are drawn by a drawing air stream, in each case, in the extrusion direction, with the filaments being deposited on a perforated tray of a conveying device to form a spunbonded nonwoven.

Prior Art

The production of spunbonded nonwovens and, respectively, nonwoven fabrics by the spunbond process, on the one hand, and by the meltblown process, on the other hand, is known from the prior art. In the spunbond process (e.g., GB 2 114 052 A or EP 3 088 585 A1), the filaments are extruded through a nozzle and pulled off and drawn by a drawing unit located underneath. By contrast, in the meltblown process (e.g., U.S. Pat. No. 5,080,569 A, 4,380,570 A or U.S. Pat. No. 5,695,377 A), the extruded filaments are entrained and drawn by hot, fast process air as soon as they exit the nozzle. In both technologies, the filaments are deposited in a random orientation on a deposit surface, for example, a perforated conveyor belt, to form a nonwoven fabric, are carried to post-processing steps and finally wound up as nonwoven rolls.

From U.S. Pat. No. 9,394,637 B2, a process for the production of a staple fibre based nonwoven fabric is known, wherein the properties of the nonwoven fabric are modified by means of hydroentanglement. Such hydroentanglements are described, for example, in EP 2 462 269 B1 and EP 1 873 290 B1. In the process, for example, several layers of nonwoven fabric can be linked by the hydroentanglement, and the mechanical properties or the three-dimensional structure of the nonwoven fabrics can be changed by perforating the nonwoven fabric or by introducing an embossing pattern.

Furthermore, it is known (U.S. Pat. No. 10,273,635, EP 1 616 052 B1 and EP 1 567 322 B1) that, in the production of paper webs, embossing patterns can be incorporated into the paper web directly by the conveyor belt and can be solidified by the subsequent drying step. Since the cellulose fibres are washed in a thin suspension onto the conveyor belt and the liquid is discharged through the conveyor belt while the cellulose fibres remain on the conveyor belt, the three-dimensional structure of the conveyor belt is transmitted to the paper web.

In commercially available systems for the production of thermoplastic spunbonded nonwovens, hydroentanglement plants are usually not required, since the spunbonded nonwoven layers are fused together via a calendar.

It is also known from the prior art to produce cellulosic spunbonded nonwovens according to the spunbond technology (e.g., U.S. Pat. No. 8,366,988 A) and according to the meltblown technology (e.g., U.S. Pat. No. 6,358,461 A and 6,306,334 A). A lyocell spinning mass is thereby extruded and drawn in accordance with the known spundbond or meltblown processes, however, prior to the deposition into a nonwoven, the filaments are additionally brought into contact with a coagulant in order to regenerate the cellulose and produce dimensionally stable filaments. The wet filaments are finally deposited in a random orientation as a nonwoven fabric.

The hydroentanglement of lyocell spunbonded nonwoven is described, for example, in U.S. Pat. No. 8,282,877 B2. Since lyocell spunbonded nonwovens are continuous filaments, three-dimensional structures cannot be imprinted by means of energy-saving suspension like in the paper industry. The moist and heavy filaments are crosslinked with each other too strongly for this. Thus, hydroentanglement can take place only with a high energy input for structuring the crosslinked cellulose filaments, which has a negative effect on the energy costs of a plant for the production of cellulosic spunbonded nonwoven.

SUMMARY OF THE INVENTION

Therefore, it is the object of the invention to provide a process for the production of spunbonded nonwoven of the initially mentioned type, which enables an efficient, technically simple and thus inexpensive introduction of an embossing pattern into the spunbonded nonwoven.

The invention achieves the object that is posed in that the perforated tray has an embossing structure with an embossing pattern, the filaments are pressed into the embossing structure by the drawing air stream and the spunbonded nonwoven thus formed is provided with the embossing pattern.

It has been shown that a direct structuring of the spunbonded nonwoven with an embossing pattern may take place already during the deposition of the filaments on a tray of the conveying device, if the perforated tray has an embossing structure with an embossing pattern. The filaments can thereby be pressed into the embossing structure by the drawing air stream, and the spunbonded nonwoven thus formed can be provided directly with the embossing pattern. Technically complex processing steps for introducing an embossing pattern and occurring downstream of the web formation can thus be omitted. Hence, an efficient and inexpensive process can be provided.

The process according to the invention thus enables in particular the direct structuring of a cellulosic spunbonded nonwoven with the aid of three-dimensional embossing structures. In doing so, the embossing structures can have any embossing pattern.

The perforated tray of the conveying device that is provided with the embossing structure may be designed in particular as an integral part of the conveying device. In this case, for example, conveyor belts, rotating drums or comparable devices may be suited as conveying devices.

The production of cellulosic spunbonded nonwovens as per the process according to the invention results in numerous improvements and advantages in terms of economic efficiency and operation. Since a downstream hydroentanglement for introducing the embossing pattern into the spunbonded nonwoven may be omitted, both the costs and the complexity of the production plant can be reduced. In addition, power and water consumption can be reduced, and, thus, the economic efficiency of the process can be increased. Furthermore, the running maintenance costs of the process can also be reduced, since, due to the elimination of hydroentanglement, there are no nozzle strips or filters which have to be cleaned or replaced.

In particular, it has been shown that, as a result of the large amounts of drawing air during the production of cellulosic spunbonded nonwovens according to the present process, which can be increased approximately 10-fold especially in comparison to thermoplastic spunbonded nonwovens, the drawing air stream's momentum onto the tray is so high that the extruded filaments are reliably pressed into the embossing structure of the tray. In fact, the extruded and drawn filaments still exhibit a high deformability during the formation of the spunbonded nonwoven on the tray and can thus reliably follow the elevations and indentations of the embossing structure, whereby the formed spunbonded nonwoven is permanently provided with the embossing pattern of the embossing structure.

Underneath the perforated tray, a suction may be provided which applies a negative pressure to the perforated tray in order to efficiently discharge the drawing air stream hitting the tray through said tray. The reliability of the process can thus be increased further, since the formation of undesirable turbulences in the area of the tray can be avoided.

The reliability and quality of the embossing process can be influenced by numerous parameters. For example, by increasing or reducing the drawing air pressure, by increasing or reducing the negative pressure underneath the tray and by changing the embossing structure in the tray, e.g., by changing the depth of the embossing structure, it is possible to control how deep the embossing pattern of the embossing structure is provided in the spunbonded nonwoven.

According to the invention, it has become apparent that, depending on the embossing structure in the tray of the conveying device, a wide variety of embossing patterns on the surface of the spunbonded nonwoven and/or a wide variety of hole perforations can be generated, which influence in particular the thickness, the appearance, the feel and the softness of the produced spunbonded nonwoven. Thus, after having been provided with an embossing pattern according to the invention, the spunbonded nonwoven can, for example, have a significantly greater perceptible thickness than a spunbonded nonwoven with an identical basis weight, but without an embossing pattern.

In addition to the embossing structure, perforations are provided in the tray which serve for discharging gases and/or liquids through the tray and are to be distinguished from the embossing structures whose function it is to introduce the embossing pattern into the spunbonded nonwoven. Thus, the perforations or, respectively, the perforated tray itself essentially fail(s) to cause the formation of an embossing pattern in the spunbonded nonwoven.

A reliable introduction of the embossing pattern into the spunbonded nonwoven can be achieved if the height of the embossing structures, i.e., the difference in height between projections and indentations in the embossing structure, is greater than or equal to 0.1 mm. In preferred embodiments of the invention, the height of the embossing structures is at least 0.5 mm, particularly preferably at least 1 mm. Moreover, there may be a beneficial effect on the reliability of the introduction of the embossing pattern, if the height of the embossing structures is less than or equal to 10 mm, in preferred embodiments of the invention less than or equal to 5 mm, or particularly preferably less than or equal to 3 mm.

Furthermore, if the spunbonded nonwoven is subjected to at least one treatment step after the formation, wherein the embossing pattern is substantially preserved in the spunbonded nonwoven after the at least one treatment step, the reliability and the simplicity of the process can be improved further. Such a treatment step can, for example, consist in washing or drying, wherein the spunbonded nonwoven with the embossing pattern is subjected to washing and, subsequently, drying. Residual solvent can, in fact, be reliably removed from the spunbonded nonwoven by washing, and thus a permanently stable and solvent-free spunbonded nonwoven can be created. In this case, the washing may preferably be designed as a countercurrent washing.

If the spunbonded nonwoven provided with the embossing pattern furthermore undergoes a hydroentanglement after the formation, with the spunbonded nonwoven being provided with a second embossing pattern during the hydroentanglement, complex embossing patterns can be introduced into the spunbonded nonwoven in a technically simple manner, which are created, for example, by superimposing two or several embossing patterns. Alternatively, it is also conceivable that the spunbonded nonwoven is provided with a second embossing pattern on a second side via the hydroentanglement. In doing so, the introduction of the second embossing pattern into the spunbonded nonwoven can, in any case, be done in such a way that the first embossing pattern, which was provided in the spunbonded nonwoven by pressing the filaments into the embossing structure of the tray, remains substantially unchanged during the hydroentanglement.

In a further embodiment variant of the invention, a process for the production of multi-layered spunbonded nonwovens can be provided in which the spinning mass is extruded through a plurality of nozzle holes of several spinnerets arranged one behind the other to form filaments and the filaments are each drawn in the extrusion direction by a drawing air stream, wherein the respective filaments of the spinnerets are deposited on top of each other on the perforated tray to form a multi-layered spunbonded nonwoven. In doing so, the multi-layered spunbonded nonwoven thus created can be reliably provided with the embossing pattern as described above and, in addition, can have a desired multi-layered structure of layers (for example, by spunbonded nonwovens with different properties being superimposed).

Depending on the basis weight of the individual layers of spunbonded nonwoven in the multi-layered spunbonded nonwoven, the embossing pattern can then be formed either by all of the spunbonded nonwoven layers, by part of the spunbonded nonwoven layers or only in a first spunbonded nonwoven layer.

The process according to the invention can be used particularly advantageously for the production of spunbonded nonwoven from a lyocell spinning mass. The spunbonded nonwoven thus produced will then be a cellulosic spunbonded nonwoven, with the lyocell spinning mass being a solution of cellulose in a direct solvent, in particular a tertiary amine oxide in an aqueous solution.

In this case, the direct solvent may be a tertiary amine oxide, preferably N-methylmorpholine-N-oxide (NMMO) in aqueous solution or an ionic liquid in which cellulose can be dissolved without chemical derivatisation.

In this case, the content of cellulose in the spinning mass may range between 4% and 17%, preferably between 5% and 15%, particularly preferably between 6% and 14%.

The throughput of cellulose per spunbonded nonwoven nozzle may range from 5 kg/h per m nozzle length to 500 kg/h per m nozzle length.

Furthermore, the drawing air stream can have a temperature of between 20° C. and 200° C., preferably between 60° C. and 160° C., particularly preferably between 80° C. and 140° C.

The drawing air pressure, i.e., the air pressure of the drawing air stream during the exit from the drawing air nozzles, can be between 0.05 bar and 5 bar, preferably between 0.1 bar and 3 bar, particularly preferably between 0.2 bar and 1 bar.

The required amount of drawing air may be between 20 $Nm^3$ (standard cubic metres) and 900 $Nm^3$ per kg of cellulose. In preferred embodiments of the invention, the required amount of drawing air may preferably be between 40 $Nm^3$ and 500 $Nm^3$ per kg of cellulose, particularly preferably between 60 $Nm^3$ and 300 $Nm^3$ per kg of cellulose.

In addition, the internal structure of the spunbonded nonwovens can be reliably controlled if the filaments extruded from the spinneret are coagulated at least partly. For this purpose, the filaments can preferably be charged with a coagulation air stream, which comprises a coagulation liquid. In this case, a coagulation air stream can preferably be a fluid containing water and/or a fluid containing coagulant, for example, gas, mist, vapour, etc.

If NMMO is used as the direct solvent in the lyocell spinning mass, the coagulation liquid may be a mixture of demineralized water and 0% by weight to 40% by weight of NMMO, preferably 10% by weight to 30% by weight of NMMO, particularly preferably 15% by weight to 25% by weight of NMMO. A particularly reliable coagulation of the extruded filaments can thereby be achieved.

It is furthermore an object of the invention to provide a device for the production of spunbonded nonwoven according to the preamble of claim 8 which enables a reliable and technically simple introduction of an embossing pattern into the spunbonded nonwoven.

The invention achieves the object that is posed by the features of the characterizing part of claim 8.

If the perforated tray has an embossing structure with an embossing pattern, a technically and structurally simple device can be created which allows a reliable embossing of a spunbonded nonwoven with an embossing pattern. The filaments are first extruded through the spinnerets and then drawn by the drawing air stream in the drawing device. The drawn and accelerated filaments can then directly hit the tray with the embossing structure. In this case, the drawing air stream is oriented in its flow direction in such a way that the extruded and drawn filaments are pressed into the embossing structure of the tray and the spunbonded nonwoven is provided with the embossing pattern of the embossing structure.

By means of the present invention, a device is thus provided which enables the direct structuring of a spunbonded nonwoven, i.e., the introduction of an embossing pattern into it, and, associated therewith, a change in the three-dimensional structure, the appearance, the feel and the softness of the spunbonded nonwoven. This happens especially without the device having to comprise further means, such as hydroentanglement, in which the spunbonded nonwoven is provided with a corresponding embossing pattern. By omitting hydroentanglement, the investment costs for a large-scale spunbond plant, on the one hand, and the running production costs of the spunbonded nonwovens, on the other hand, can be reduced, since the power and water consumption associated with hydroentanglement can be eliminated as well. The profitability of a plant for the production of spunbonded nonwoven with embossing patterns is thus improved. The investment costs and the operating costs regarding hydroentanglement can be either completely eliminated or significantly reduced. If such a hydroentanglement is to be arranged downstream for the further solidification of the web formation, the operating costs can be reduced substantially, since such a hydroentanglement can be operated with significantly lower power.

The above-mentioned advantages take effect especially if the device comprises a washing for washing the spunbonded nonwoven after it has been formed and a dryer for drying the spunbonded nonwoven after washing.

If the device furthermore exhibits a suction underneath the perforated tray for discharging the drawing air stream, the pressing of the filaments into the embossing structure of the tray can be improved further and the reliability of the device can thus be increased further. This is the case especially if the drawing air stream is furthermore extracted through the perforated tray.

If the device comprises a hydroentanglement on a conveyor belt between washing and dryer, with the conveyor belt having a second embossing structure with a second embossing pattern, a combination of the direct structuring according to the invention of the spunbonded nonwoven on the tray and an additional direct structuring of the spunbonded nonwoven during hydroentanglement may take place in a technically simple manner, and thus the production of spunbonded nonwovens with complex multi-layered embossing patterns can be enabled.

BRIEF DESCRIPTION OF THE DRAWINGS

Preferred embodiment variants of the invention are described in further detail below with reference to the drawings.

DETAILED DESCRIPTION OF THE INVENTION

Figure 1:
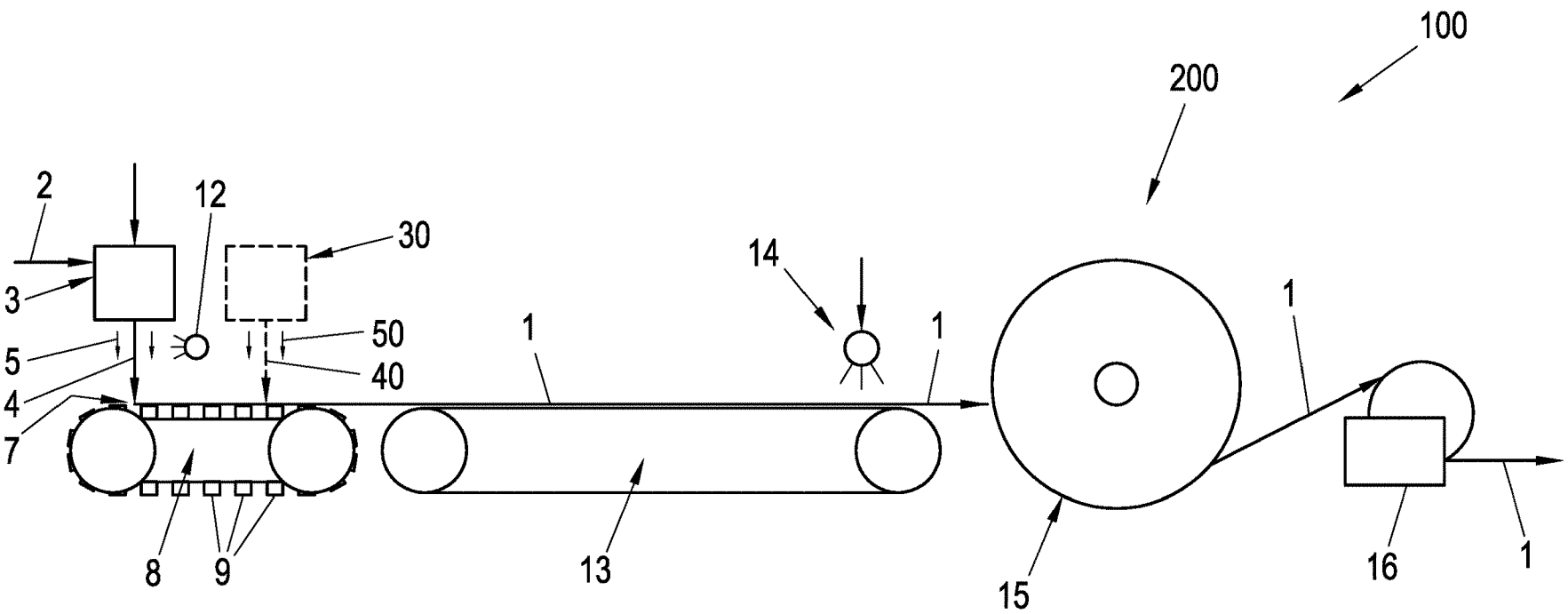
FIG. 1 shows a schematic illustration of the process according to the invention as per a first embodiment variant.

FIG. 1 shows a process 100 according to the invention for the production of a spunbonded nonwoven 1 with an embossing pattern 10 and a device 200 for performing the process 100 according to a first embodiment variant of the invention. In a first process step, a spinning mass 2 is produced from a cellulosic raw material and supplied to a spinneret 3 of the device 200. In this case, the cellulosic raw material for producing the spinning mass 2, which production is not shown in further detail in the figures, can be a pulp made of wood or other plant-based starting materials, which is suitable for the production of lyocell fibres. However, it is also conceivable that the cellulosic raw material consists of or contains production waste from the production of spunbonded nonwoven or recycled textiles. In this case, the spinning mass 2 is a solution of cellulose in NMMO and water, with the cellulose content in the spinning mass ranging between 3% by weight and 17% by weight.

Figure 3:
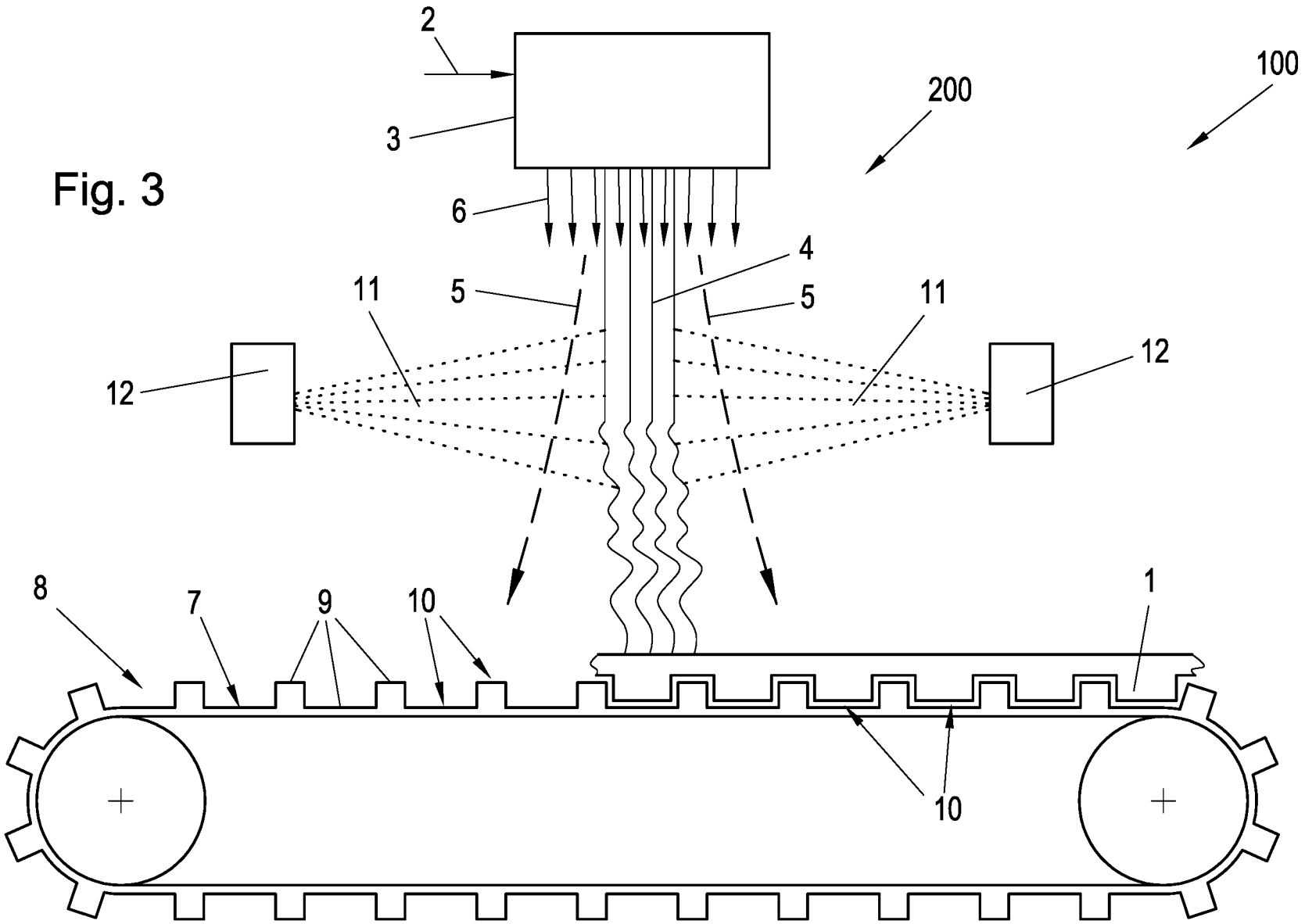
FIG. 3 shows a schematic detailed view of the extrusion, drawing and deposition of the filaments according to the process illustrated in FIG. 1.

In a following step, the spinning mass 2 is then extruded through a plurality of nozzle holes in the spinneret 3 to form filaments 4. In this connection, FIG. 3 shows a detailed schematic illustration of the process sequence. The extruded filaments 4 are then accelerated and drawn in a drawing air stream 5. For generating the drawing air stream 5, a drawing device 6 is provided in the spinneret 3, which ensures that the drawing air stream 5 exits the spinneret 3 in order to accelerate the filaments 4 after their extrusion.

In one embodiment variant, the drawing air stream can emerge between the nozzle holes of the spinneret 3. In a further embodiment variant, the drawing air stream can alternatively emerge around the nozzle holes. However, this is not shown in further detail in the figures. Such spinnerets 3 comprising drawing devices for generating a drawing air stream are known from the prior art (U.S. Pat. No. 3,825,380 A, 4,380,570 A, WO 2019/068764 A1).

In the illustrated preferred embodiment, the extruded and drawn filaments 4 are additionally charged with a coagulation air stream 11, which is provided by a coagulation device 12. The coagulation air stream 11 usually comprises a coagulation liquid, for example, in the form of vapour, mist, etc. Due to the contact of the filaments 4 with the coagulation air stream 11 and the coagulation liquid contained therein, the filaments 4 are coagulated at least partly, which, in particular, reduces adhesions between the individual extruded filaments 4.

As can be seen furthermore from FIG. 3, the drawn and at least partially coagulated filaments 4 are then deposited in a random orientation on the tray 7 of a conveying device 8. In this case, the tray 7 of the conveying device 8 has an embossing structure 9 with an embossing pattern 10. The extruded and drawn filaments 4 are then pressed into the tray 7 by means of the drawing air stream 5, forming the spunbonded nonwoven 1 there. After the spunbonded nonwoven 1 has been formed, it exhibits the embossing pattern 10 from the embossing structure 9. The embossing pattern 10 or, respectively, the three-dimensional structure of the spunbonded nonwoven 1 can thus be embossing according to the invention by the embossing structure 9 in the tray 7, and the directly structured cellulosic spunbonded nonwoven 1 according to the invention can be produced without any additional downstream process steps.

As illustrated in FIG. 1, in the device 200 according to the invention and, respectively, in the process 100, in particular hydroentanglement may be omitted, as a result of which the length, the investment costs and the operating costs of the device 200 can advantageously be reduced.

Following the formation, the spunbonded nonwoven 1 is guided across the conveyor belt 13 through a washing 14 in which the spunbonded nonwoven 1 is washed in order to free it from residues of the solvent, namely the NMMO contained in the spinning mass 2. In a preferred embodiment variant, the washing 14 is, in this case, a multi-stage countercurrent washing, which, however, has not been illustrated in the figures. In a next step, the washed spunbonded nonwoven 1 is then supplied to a drying in a dryer 15 in order to remove the remaining moisture and to obtain a finished spunbonded nonwoven 1.

Finally, the process 200 is completed by optionally winding 16 and/or packaging the finished spunbonded nonwoven 1.

Figure 2:
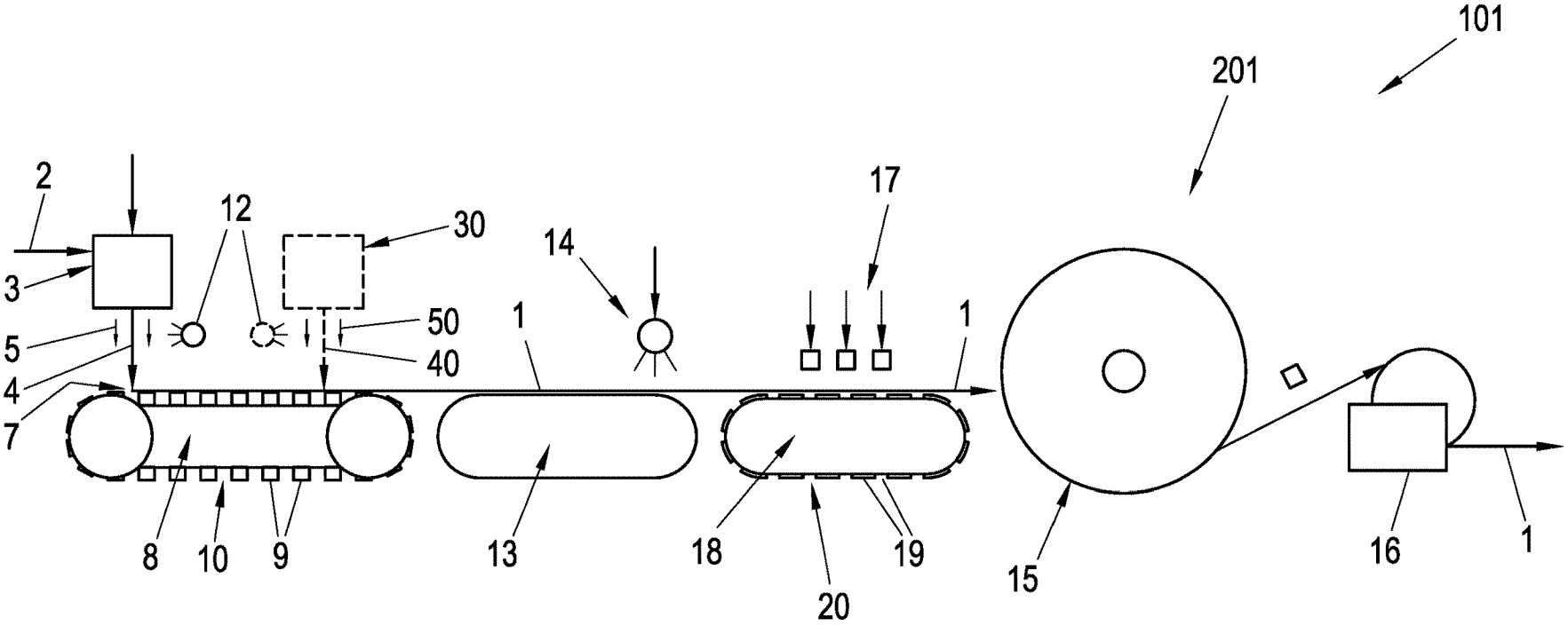
FIG. 2 shows a schematic illustration of the process according to the invention as per a second embodiment variant.

In FIG. 2, a process 101 according to the invention and a device 201 according to a second embodiment variant of the invention are illustrated. The formation of the spunbonded nonwoven 1 including extrusion, drawing, coagulation and deposition on the tray 7 exhibiting the embossing structure 9 takes place identically as described above for the first embodiment variant with reference to FIGS. 1 and 3.

In addition, in the process 201 according to the second embodiment variant, in addition to the direct structuring according to the invention on the tray 7, a hydroentanglement 17 is provided. In this case, the spunbonded nonwoven 1 is deposited on a further conveyor belt 18 after washing 14, the conveyor belt 18 having a second embossing structure 19 with a second embossing pattern 20. The spunbonded nonwoven 1, which already exhibits the embossing pattern 10, is then hydroentangled over the conveyor belt 18, i.e., sprayed with water at a high pressure, whereby the spunbonded nonwoven 1 is pressed into the second embossing structure 19 of the conveyor belt 18 and the second embossing pattern 20 is transferred to the spunbonded nonwoven 1.

By combining the direct structuring on the tray 7 with the embossing structure 9 and the hydroentanglement with the second embossing structure 19, it becomes possible to manufacture even more product variations of the spunbonded nonwoven 1 with embossing patterns 10, 20. Despite the fact that hydroentanglement 17 is provided, both the investment costs of the device 201 and the operating costs of the hydroentanglement 17 can be reduced substantially in comparison to systems from the prior art, since a large part of the three-dimensional structuring of the spunbonded nonwoven 1 takes place already on the tray 7.

In a further embodiment variant, which is only indicated in the figures, the device 100 and, respectively, the process 200 can have at least a first spinneret 3 and a second spinneret 30, the spinning mass 2 being extruded simultaneously through the first spinneret 3 and the second spinneret 30 to form the filaments 4, 40. In doing so, the filaments 4, 40 are each drawn in the extrusion direction by means of a drawing air stream 5, 50 and coagulated at least partly, wherein the filaments 4 of the first spinneret 3 are deposited on the conveying device 8 to form a first spunbonded nonwoven 1 and the filaments 40 of the second spinneret 30 are deposited on the conveying device 8 to form a second spunbonded nonwoven.

The filaments 40 of the second spinneret 30 are deposited on the conveying device 8 to form the second spunbonded nonwoven on the first spunbonded nonwoven 1 in order to obtain a multi-layered spunbonded nonwoven, which is not shown in further detail in the figures. In the multi-layered spunbonded nonwoven according to the invention, the embossing pattern 10, which has been introduced into the first spunbonded nonwoven 1 through the tray 7, can surprisingly be reproduced also through the entire multi-layered spunbonded nonwoven.

The first spunbonded nonwoven 1 and the second spunbonded nonwoven preferably undergo the washing 14 and the dryer 15 jointly in the form of the multi-layered spunbonded nonwoven.

In a further embodiment variant, which is not shown in further detail in the figures, the multi-layered spunbonded nonwoven can be unravelled into at least the first spunbonded nonwoven 1 and the second spunbonded nonwoven in a further step, in particular following the washing 14, wherein the first spunbonded nonwoven 1 and the second spunbonded nonwoven may undergo further steps, such as hydroentanglement 17 and/or drying 15, separately after unravelling.

Alternatively, in a further embodiment variant, the first spunbonded nonwoven 1 and the second spunbonded nonwoven may undergo the hydroentanglement 17 also jointly, whereby they are interconnected permanently to form the multi-layered spunbonded nonwoven.

Finally, the multi-layered spunbonded nonwoven can be supplied to an optional winding 16.

Likewise, the first spunbonded nonwoven 1 and the second spunbonded nonwoven may each have different internal properties, for example, a different basis weight or different air permeabilities, and may thus form a multi-layered spunbonded nonwoven with properties variable in cross-section.

EXAMPLES

The process according to the invention is illustrated below using an example. In each case, spunbonded nonwovens were produced in accordance with the process forming the subject manner, and the thickness of the spunbonded nonwoven was determined in accordance with DIN EN ISO 9073-2: 1997-02 (test method for nonwoven fabrics, part 2: determination of thickness).

In the examples, cellulosic spunbonded nonwovens were, in each case, produced from a lyocell spinning mass, with a solution of cellulose in a mixture of water and NMMO being used as the spinning mass.

The cellulose throughput per spinneret was 300 kg/b/m in all examples. The drawing air pressure of the drawing air stream was 0.5 bar in each of the examples.

In the example, the spunbonded nonwovens were produced as described above using the process according to the invention. In doing so, the spunbonded nonwovens that were produced had basis weights ranging between 10 and 40 g/m2. As per the information given in Table 1, the spunbonded nonwovens were thereby formed on a tray according to the invention provided with an embossing structure or on a conventional (unstructured) tray.

Table 1 shows the measured thicknesses of the spunbonded nonwovens that were produced. It thereby becomes evident that, by the direct structuring of the spunbonded nonwoven during the deposition with an embossing structure, a significant change in the thickness of the spunbonded nonwoven can be achieved despite otherwise identical process parameters.

TABLE 1

Thicknesses of the spunbonded nonwovens measured according to the example

| Basis weight ($g/m^2$) | tray with embossing structure | thickness according to DIN 29073 (mm) |
|---|---|---|
| 10 | no | 0.09-0.14 |
| 10 | yes | 0.21-0.25 |
| 40 | no | 0.25-0.28 |
| 40 | yes | 0.37-0.44 |

What is claimed is:

1. A process for producing a spunbonded nonwoven comprising cellulose with an embossing pattern comprising, extruding a spinning mass through a plurality of nozzle holes of at least one spinneret to form filaments; and drawing the filaments by a drawing air stream, wherein, in an extrusion direction, with the filaments being deposited on a perforated conveying device to form the spunbonded nonwoven, the perforated conveying device has an embossing structure with the embossing pattern, the filaments are pressed into the embossing structure by the drawing air stream and a suction device underneath the perforated conveying device, and the spunbonded nonwoven thus formed is provided with the embossing pattern.

2. The process according to claim 1, further comprising subjecting the spunbonded nonwoven to at least one treatment step after pressing into the embossing structure, wherein the embossing pattern is substantially preserved in the spunbonded nonwoven after the at least one treatment step.

3. The process according to claim 2, wherein the at least one treatment step comprises washing and/or drying.

4. The process according to claim 1, wherein the spunbonded nonwoven provided with the embossing pattern undergoes hydroentanglement after pressing into the embossing structure, with the spunbonded nonwoven being provided with a second embossing pattern during the hydroentanglement.

5. The process according to claim 1, wherein the spinning mass is extruded through the plurality of nozzle holes of a plurality of the at least one spinneret arranged one behind another to form the filaments and the filaments are each drawn in the extrusion direction by the drawing air stream, wherein the filaments respective to the plurality of the at least one spinneret are deposited on top of one another on the perforated tray to form a multi-layered spunbonded nonwoven.

6. The process according to claim 1, wherein the spinning mass is a solution of cellulose in a direct solvent.

7. The process according to claim 6, further comprising, after extrusion from the at least one spinneret, coagulating the filaments at least partly, optionally by a coagulation air stream, which optionally comprises a coagulation liquid.

8. A device for producing a cellulosic spunbonded nonwoven with an embossing pattern, comprising:

at least one spinneret configured to extrude a spinning mass into filaments;

a drawing device configured to draw the extruded filaments by means of a drawing air stream, the drawing device attached to or comprised within the at least one spinneret;

a conveying device comprising perforations configured to deposit the filaments and form the spunbonded nonwoven, and an embossing structure with an embossing pattern configured to press the filaments into the embossing structure by means of the drawing air stream and providing the embossing pattern in the spunbonded nonwoven that has been formed; and a suction device underneath the perforated conveying device.

9. The device according to claim 8, further comprising a washer configured to wash the spunbonded nonwoven after formation and a dryer configured to dry the spunbonded nonwoven after the washing.

10. The device according to claim 9, further comprising a hydroentanglement on a conveyor belt between the washer and the dryer, the conveyor belt having a second embossing structure with a second embossing pattern.

11. The process according to claim 6, wherein the direct solvent comprises a tertiary amine oxide in an aqueous solution.

* * * * *